US007091434B2

(12) United States Patent
Suzuki

(10) Patent No.: US 7,091,434 B2
(45) Date of Patent: Aug. 15, 2006

(54) DIAL SWITCH HAVING AN ORNAMENTAL COLORED RING

(75) Inventor: Tsuyoshi Suzuki, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/146,037

(22) Filed: Jun. 7, 2005

(65) Prior Publication Data

US 2005/0284741 A1 Dec. 29, 2005

(30) Foreign Application Priority Data

Jun. 28, 2004 (JP) ..... 2004-189410

(51) Int. Cl.
*H01H 9/00* (2006.01)

(52) U.S. Cl. ..... 200/316; 200/314

(58) Field of Classification Search ..... 200/310–316, 200/341–345, 336, 308, 5 R, 5 A, 512, 517, 200/317

See application file for complete search history.

(56) References Cited

U.S. PATENT DOCUMENTS 5,861,589 A * 1/1999 Sato et al. ..... 200/5 R
6,876,313 B1 * 4/2005 Hsiung et al. ..... 341/35

FOREIGN PATENT DOCUMENTS

JP A-2000-276967 10/2000

* cited by examiner

*Primary Examiner*—Michael Friedhofer
*Assistant Examiner*—Lisa Klaus
(74) *Attorney, Agent, or Firm*—Posz Law Group, PLC

(57) ABSTRACT

A dial switch disposed on a front surface of a control panel is surrounded by a colored ring which is visible from a front side of the control panel. Behind the front surface of the control panel, an ornamental prism made of a transparent material and a light source are disposed. A colored layer is formed on the rear surface of the ornamental prism so that a ring surrounding the dial switch is visible as a colored ring. The colored ring is visible through the transparent ornamental prism at the daytime and is visible by illumination of the light source in the nighttime. Since no light leaks bypassing the colored layer, the ring is perfectly colored. Since only the flat rear surface of the ornamental prism is covered with the colored layer, the ornamental prism can be manufactured in a simple process.

6 Claims, 3 Drawing Sheets

DIAL SWITCH HAVING AN ORNAMENTAL COLORED RING

CROSS-REFERENCE TO RELATED APPLICATION

This application is based upon and claims benefit of priority of Japanese Patent Application No. 2004-189410 filed on Jun. 28, 2004, the content of which is incorporated herein by reference.

BACKGROUND OF THE INVENTION

1. Field of the Invention

The present invention relates to a dial switch disposed on a control panel, the dial switch being illuminated by a colored ring surrounding the dial switch.

2. Description of Related Art

An example of a switch disposed on a control panel for use in an automobile is disclosed in JP-A-2000-276967. An area around the switch is illuminated to improve visibility.

A dial switch which is illuminated by a multi-color ring has also been proposed. An essence of such a conventional dial switch is illustrated in FIG. 4 attached hereto. The dial switch includes a transparent ornamental prism J2 disposed at a front opening of a case J1 covering a control panel, light sources J9 supported on a printed circuit board J4, and a transparent light-conducting prism J3 disposed between the light sources J9 and the ornamental prism J2. The ornamental prism J2 is formed in a cylindrical shape having a flange J2*c*. The cylindrical portion of the ornamental prism J2 is inserted into a front opening of the case J1, and the flange J2*c* is connected to a rear surface of the case J1. A red layer J2*a* forming a half circle and a blue layer J2*b* forming another half circle are printed on the rear surface of the cylindrical portion.

The light-conducting prism J3 has a cylindrical portion and an inside plate portion having a center hole. The light-conducting prism J3 is disposed so that an axial end of its cylindrical portion faces the red layer J2*a* and the blue layer J2*b*. A rotary switch J7 having a shaft J6 and a dial knob J5 connected to the shaft J6 is mounted on the printed circuit board J4. The shaft J6 extends to a front side of the case J1 through the center hole of the light-conducting prism J3. The surface of the light-conducting prism J3 facing the front side is covered with a light-blocking layer J8 consisting of a white layer J8*a* as an under-layer and a black layer J8*b* as an over-layer.

In the daytime when the control panel is not illuminated, the red layer J2*a* and the blue layer J2*b* are visible from the front side of the case J1 because the ornamental prism J2 is transparent. Therefore, a front end of the ornamental prism J2 surrounding the dial knob J5 is colored in red for a half circle and in blue for another half circle. This enhances an ornamental design of the control panel. In the nighttime when the light sources J9 are lit, the light is led from the light sources J9 to the front circle surrounding the dial knob J5 through the light-conducting prism J3, the colored layers J2*a*, J2*b* and the ornamental prism J2. Therefore, the circle surrounding the dial knob J5 is illuminated by a colored ring. Thus, the ornamental design of the control panel is enhanced.

In the conventional dial switch illuminated by the colored ring, however, the front surface of the light-conducting prism J3 has to be covered with the light-blocking layer J8 consisting of the white layer J8*a* and the black layer J8*b*. The light-blocking layer J8 is formed by painting, for example.

In the painting process, surfaces of the light-conducting prism J3, which are not covered with the light-blocking layer, must be masked. The painting process as a whole makes the manufacturing process complex. Further, in the conventional dial switch, the light from the light sources J9 leaks through the center hole of the light-conducting prism J3, a gap between the light-conducting prism J3 and the ornamental prism J2 and the flange J2*c* of the ornamental prism J2, as shown with arrows in FIG. 4. The light color leaked through these portions has a color of the light sources J9, and is different from the light color passing through the red layer J2*a* and the blue layer J2*b*. Therefore, ornamental effects of the colored ring are adversely affected by the leaked light.

SUMMARY OF THE INVENTION

The present invention has been made in view of the above-mentioned problems, and an object of the present invention is to provide an improved dial switch having an ornamental colored ring, wherein its manufacturing process is simplified and ornamental effects are enhanced.

The dial switch is disposed on a front surface of a control panel such as an automotive air-conditioner control panel. The dial switch is surrounded by an ornamental colored ring appearing on the front surface of the control panel. The control panel is covered with a case made of a non-transparent material. An ornamental prism made of a transparent material is connected to a front opening of the case. The ornamental prism is composed of a plate portion and a cylindrical portion formed on the front surface of the plate portion. A colored layer is formed on the rear surface of the plate portion. A printed circuit board, on which a light source and a rotary switch forming the dial switch are mounted, is disposed behind the colored layer.

The colored layer is formed on an entire circular area of the rear surface of the plate portion. The circular area may be divided into two portions by a diametric line passing through the center of the circular area, and the two portions may be colored in respectively different colors, e.g., red and blue. The circular area may be divided into three or more portions by lines radially extending from the center of the circular area, and each portion may be colored in a respectively different color. Alternatively, the circular area may be colored in colors gradationally changing along the circumferential direction around the center of the circular area. A light-conducting prism may be disposed between the light source and the ornamental prism to obtain even brightness on the colored ring. In place of the light-conducting prism, a layer for suppressing uneven brightness may be formed on the rear surface of the ornamental prism.

In the daytime when the control panel is not illuminated, the colored ring around the dial switch is visible through the transparent ornamental prism from the front side of the control panel. In the nighttime when the control panel is illuminated, the colored ring is illuminated and visible from the front side of the control panel. Since only the flat portion of the ornamental prism is covered with the colored layer, the ornamental prism can be manufactured in a simplified process. Since no light is emitted without going through the colored layer, the colored ring is perfectly colored, and therefore ornamental effects of the control panel are enhanced.

Other objects and features of the present invention will become more readily apparent from a better understanding of the preferred embodiment described below with reference to the following drawings.

DETAILED DESCRIPTION OF THE PREFERRED EMBODIMENT

Figure 1:
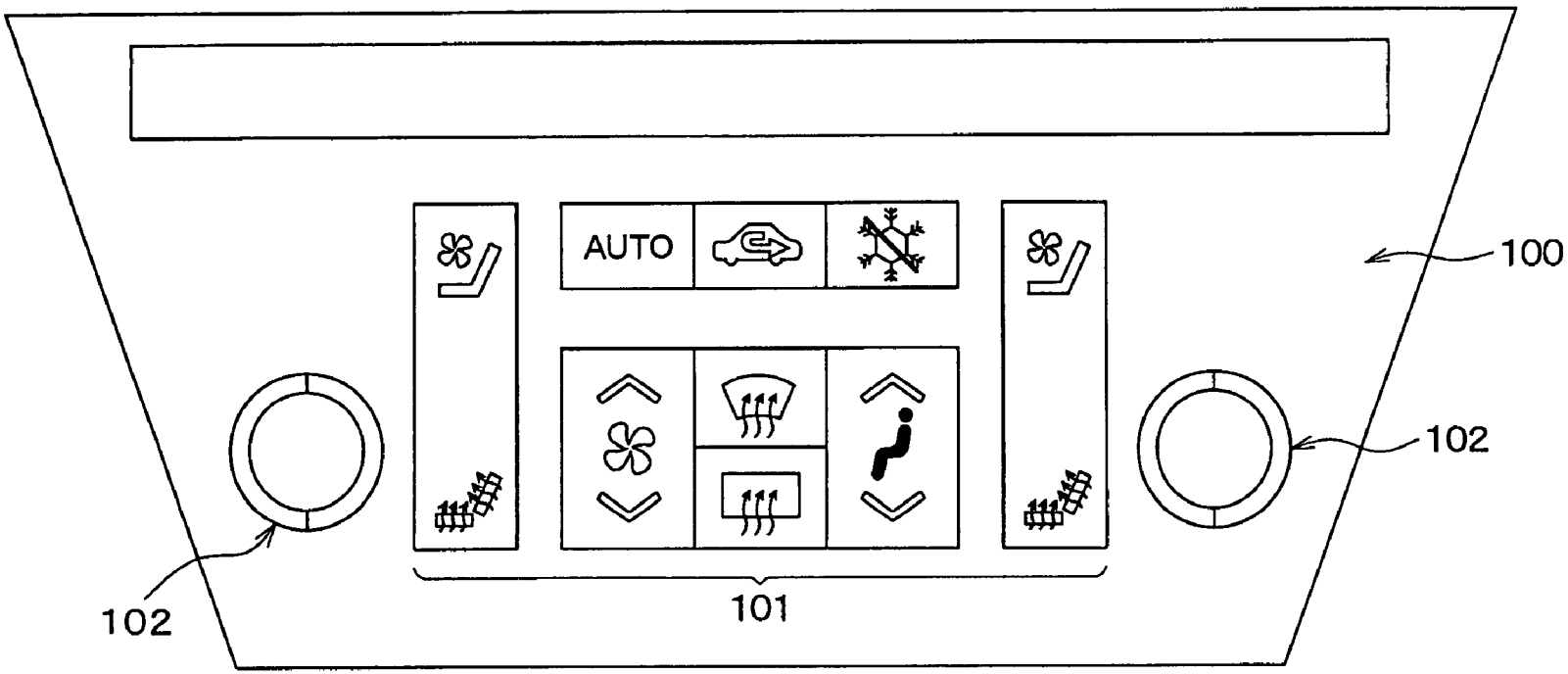
FIG. 1 is a plan view showing a control panel for an automotive air-conditioner, the control panel having a dial switch illuminated by a multi-color ring according to the present invention.

A preferred embodiment of the present invention will be described with reference to accompanying drawings. FIG. 1 shows a control panel for controlling an air-conditioner system mounted on an automotive vehicle. The control panel 100 is disposed at a center portion of an instrument panel of the automotive vehicle. Various control switches 101 are included in the control panel 100, and two dial switches 102 are positioned at both sides of the control switches 101. The present invention is applied to each dial switch 102.

Figure 2:
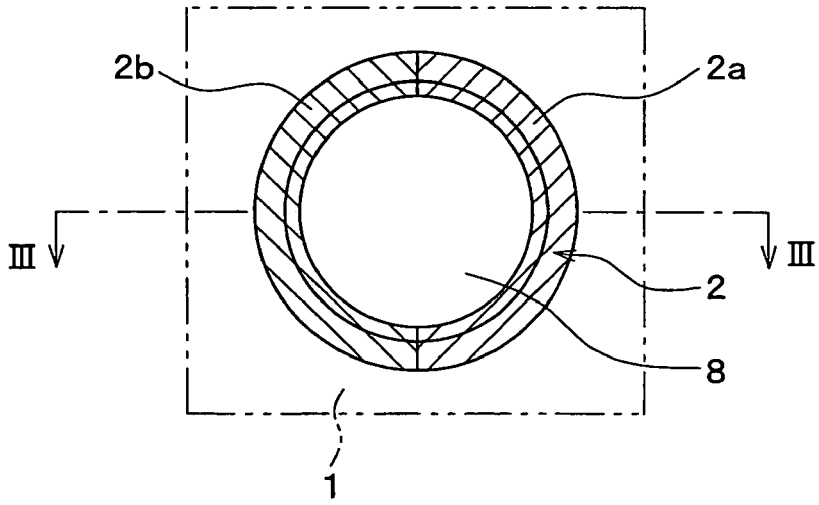
FIG. 2 is an enlarged front view showing the dial switch shown in FIG. 1.
Figure 3:
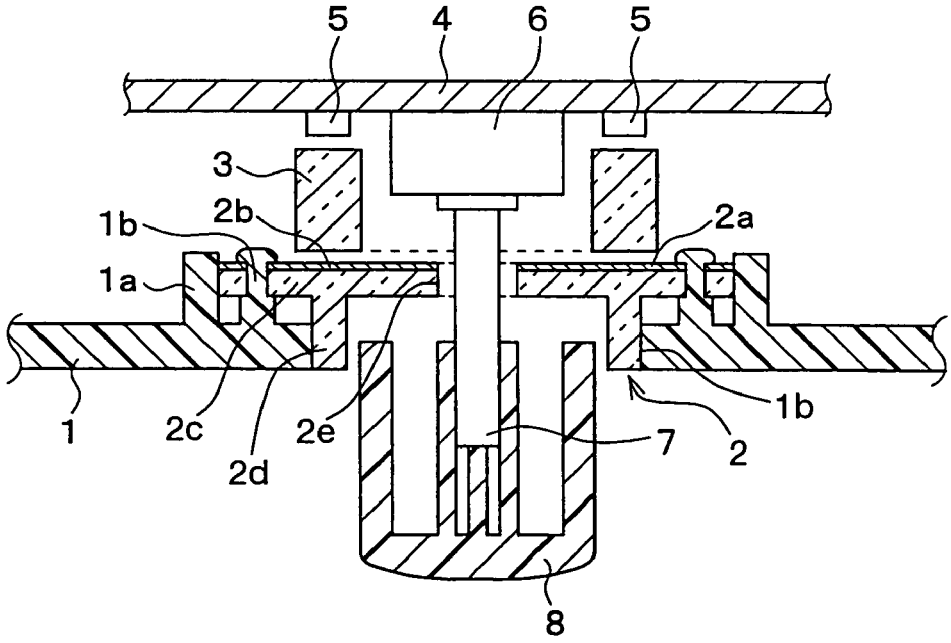
FIG. 3 is a cross-sectional view showing the dial switch having the multi-color ring, taken along line III—III shown in FIG. 2.
Figure 4:
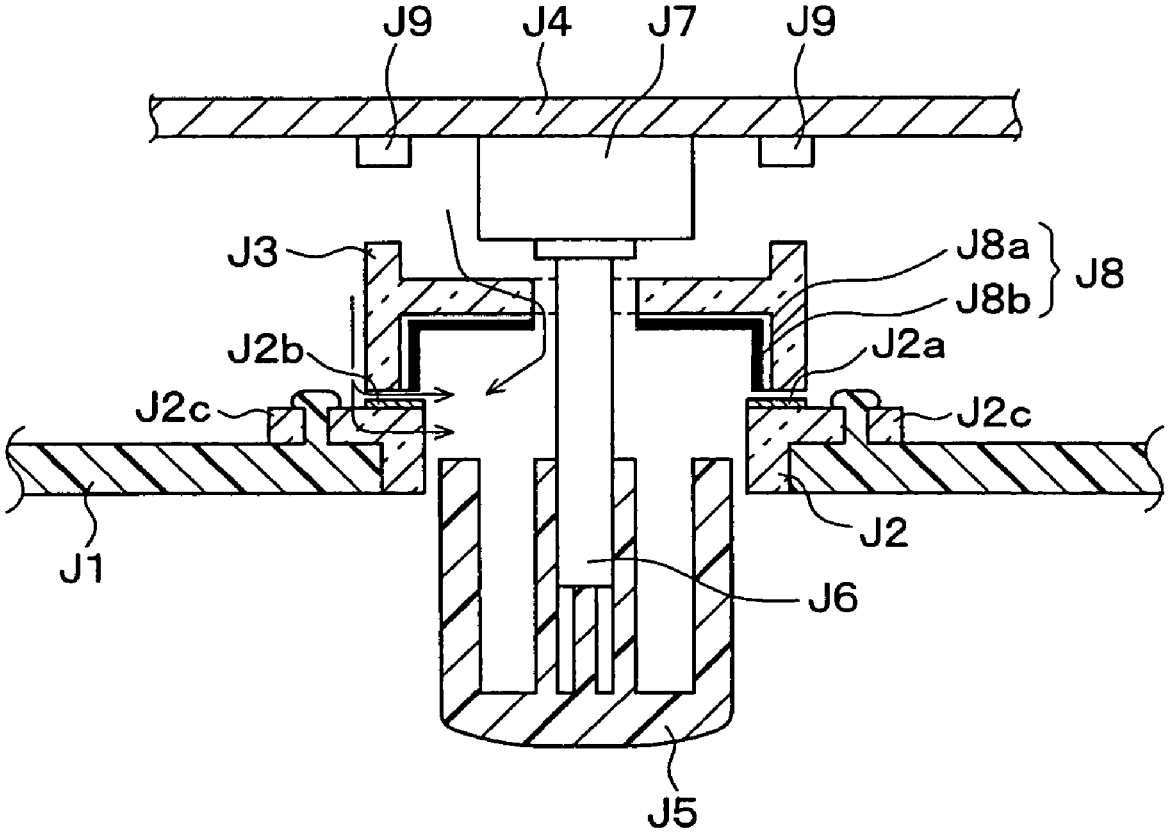
FIG. 4 PRIOR ART
FIG. 4 is a cross-sectional view showing a conventional dial switch having a multi-color ring.

With reference to FIGS. 2 and 3, the dial switch 102 having an ornamental colored ring surrounding the dial switch will be described. In FIG. 2, a front view of the dial switch, viewed from the front side of the control panel 100, is shown in an enlarged scale. In FIG. 3, a cross-sectional view taken along line III—III of FIG. 2 is shown. The colored ring, which is colored in red and blue in this particular embodiment, is visible from the front side of the control panel 100 through an ornamental prism 2 in the daytime when the control panel is not illuminated. In the nighttime when the control panel 100 is illuminated, the colored ring is illuminated by light emitted through the ornamental prism 2.

As shown in FIG. 3, the dial switch includes a rotary switch 6 mounted on a printed circuit board 4, a shaft 7 extending from the rotary switch 6 and a dial knob 8 connected to the shaft 7. The colored ring, which is illuminated in the nighttime, is composed of an ornamental prism 2 connected to a case 1, a light-conducting prism 3 and light sources 5. The case 1 covering the control panel 100 is made of a non-transparent material, colored in black for example. A supporting member 1*a* for supporting an outside of the ornamental prism 2 is formed on the rear surface of the case 1. Projections 1*b* for fixing the ornamental prism 2 are also formed on the rear surface of the case 1.

The ornamental prism 2 is made of a transparent and light-conductive material, and is composed of a plate portion 2*c* having a center hole 2*e* and a cylindrical portion 2*d* which is inserted into an opening 1*b* of the case 1. The front end of the cylindrical portion 2*d* is aligned to be flat with the front surface of the case 1. The plate portion 2*c* has holes to be connected to the projections 1*b* of the case 1. The ornamental prism 2 is connected to the case 1 by staking top portions of the projections 1*b*.

The rear surface of the plate portion 2*c* of the ornamental prism 2 is covered with a red layer 2*a* and a blue layer 2*b*. A circular area of the rear surface is divided into two portions by a diametric line passing through the center of the circular area, and a half of the circular area is covered with the red layer 2*a* and the other half is covered with the blue layer 2*b*. Both the red and blue layers 2*a*, 2*b* may be formed by printing. The light-conducting prism 3 formed in a substantially cylindrical shape is positioned between the light sources 5 mounted on the printed circuit board 4 and the ornamental prism 2. The light-conducting prism 3 may be cut in a slanted shape so that the light from the light sources 5 is uniformly led to the colored ring.

The light sources 5 may be formed by light-emitting diodes (LEDs), and they are lit when a headlight switch of an automobile is turned on at the nighttime, for example. The rotary switch 6 mounted on the printed circuit board 4 is rotated by rotating the dial knob 8, to thereby adjust a temperature to be controlled by an air-conditioner, for example.

The front end of the cylindrical portion 2*d* of the ornamental prism 2, which is exposed to the front surface of the control panel 100, serves as the colored ring surrounding the dial switch, or the dial knob 8 of the dial switch. In the daytime when the control panel 100 is not illuminated, the colored ring is visible in red and blue colors from the front side of the control panel 100 because the ornamental prism 2 having the red and blue layers 2*a*, 2*b* is transparent. In the nighttime when the control panel 100 is illuminated, i.e., when the light sources 5 are lit, the colored ring is visible in red and blue colors because the light of the light sources 5 is conducted through the light-conducting prism 3, the red and blue layers 2*a*, 2*b* and the ornamental prism 2. Therefore, in both the daytime and the nighttime, the colored ring enhances the ornamental design of the control panel.

Since an entire area of the rear surface of the ornamental prism 2 is covered with the red layer 2*a* and the blue layer 2*b*, the light from the light sources 5 all passes through the colored layers 2*a*, 2*b*. Therefore, the light from light sources 5 does not leak to the front side of the control panel 100. Since the supporting member 1*a* and the projections 1*b* of the case 1 are made of a non-transparent material, the light from the light sources 5 does not enter into the ornamental prism 2 from the end surface of the plate portion 2*c*. Therefore, light bypassing the colored layers 2*a*, 2*b* is not emitted from the colored ring. Though a small amount of light may leak through the center hole 2*e* of the plate portion 2*c*, it little disturbs the colored light because the position where the leaked light comes out overlaps with the position where the colored layer 2*a* or 2*b* are formed. In this manner, the ornamental design of the control panel is enhanced by the present invention.

Since the colored layers 2*a*, 2*b* are printed on the flat rear surface of the plate portion 2*c* of the ornamental prism 2, the printing process can be easily carried out. Further, since there is no need to form a light-blocking layer on the light-conducting prism 3, a manufacturing process of the light-conducting prism 3 can be simplified.

The present invention is not limited to the embodiment described above, but it may be variously modified. For example, though the circular area of the rear surface of the ornamental prism 2 is divided into two portions, i.e., portions for the red and blue layers, in the foregoing embodiment, the circular area may be divided into several portions. In this case, the circular area is divided like a pie chart, and the respective pie chart portions are differently colored. Alternatively, the colored layer may be formed to gradationally change its colors along the circumferential direction around the center of the circular surface.

Though the light-conducting prism 3 is used in the foregoing embodiment to uniformly conduct the light from the light sources 5, it may be eliminated. In place of the light-conducting prism 3, a layer for suppressing uneven brightness may be formed on the red layer 2*a* and the blue layer 2*b*. The suppressing layer may be over-printed on the colored layers 2*a*, 2*b*, or may be formed as printed dots. The colored layers 2*a*, 2*b* may be formed by other processes than printing. Further, the area in which the colored layers are formed is not limited to the circular area, but it may be a square or other shapes. Though the present invention is applied to the control panel for controlling an automotive air-conditioner in the foregoing embodiment, it may be applied to other devices such as a volume-control switch for an audio device.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A dial switch disposed on a control panel, the dial switch comprising:

a case covering the control panel, the case being made of a non-transparent material and having an opening;

an ornamental prism having a plate portion and a cylindrical portion formed on a front surface of the plate portion, the plate portion having a center hole, the cylindrical portion being inserted into the opening of the case;

a colored layer formed on a rear surface of the plate portion;

a light-source disposed behind the colored layer;

a printed circuit board on which the light source is supported, electric power being supplied to the light source from the printed circuit board;

a rotary switch supported on the printed circuit board, the rotary switch having a shaft extending through the center hole of the plate portion to a front side of the case; and a dial knob connected to the shaft so that the shaft being rotated by rotating the dial knob, wherein:

the colored layer covers substantially an entire area of the rear surface of the plate portion, so that light is led from the light source to a front surface of the case through the colored layer and the cylindrical portion of the ornamental prism.

2. The dial switch as in claim 1, wherein:

the colored layer is divided into two portions, a first portion and a second portion, by a diametric line passing a center of the center hole of the plate portion; and the first portion is colored in a first color and the second portion in a second color.

3. The dial switch as in claim 1, wherein:

the colored layer gradationally changes its colors along a circumferential direction around a center of the center hole.

4. The dial switch as in claim 1, wherein:

the colored layer is divided into a plurality of portions by lines radially extending from a center of the center hole; and the plurality of portions are colored in colors different from each other.

5. The dial switch as in claim 1, wherein:

a layer for suppressing uneven brightness is formed on the colored layer.

6. The dial switch as in claim 1, wherein:

a light-conducting prism for conducting light from the light source to the colored layer is disposed between the light source and the ornamental prism.

* * * * *